United States Patent [19]

Henn

[11] Patent Number: 5,036,948

[45] Date of Patent: Aug. 6, 1991

[54] SOUND ABSORPTION DEVICE OR MUFFLER FOR BLOW NOZZLES

[75] Inventor: Manfred Henn, Heidelberg, Fed. Rep. of Germany

[73] Assignee: Heidelberger Druckmaschinen AG, Heidelberg, Fed. Rep. of Germany

[21] Appl. No.: 461,245

[22] Filed: Jan. 5, 1990

[30] Foreign Application Priority Data

Jan. 12, 1989 [DE] Fed. Rep. of Germany ..... 3900723

[51] Int. Cl.[5] ..... F01N 1/24

[52] U.S. Cl. ..... 181/258; 138/42

[58] Field of Search ..... 181/252, 256, 258; 55/DIG. 30, DIG. 31, 43, 44, 276; 138/42

[56] References Cited

U.S. PATENT DOCUMENTS

| | | | |
|---|---|---|---|
| 1,554,534 | 9/1925 | Streussler | 181/258 |
| 1,627,324 | 5/1927 | Green | 181/258 |
| 2,805,685 | 9/1957 | Jopson | 138/42 |
| 3,677,300 | 7/1972 | King | 138/42 |
| 3,823,743 | 7/1974 | King | 181/258 |

FOREIGN PATENT DOCUMENTS 1250220 4/1972 Fed. Rep. of Germany .

*Primary Examiner*—Benjamin R. Fuller
*Assistant Examiner*—Alrick Bobb
*Attorney, Agent, or Firm*—Herbert L. Lerner; Laurence A. Greenberg

[57] ABSTRACT

A sound absorption device for a blow nozzle formed with a bore extending from a low-pressure side of the nozzle, at which a gas flow enters the nozzle, to a high-pressure side of the nozzle, at which the gas flow streams from the nozzle through a nozzle opening formed at an end of the bore, includes a sound-absorbing insert for muffling noise which results from a variation in density of the gas flow as it streams through the nozzle opening and has frequencies ranging over substantially the entire audible frequency range, the sound-absorbing insert being shaped as a truncated cone and being rigidly set into the bore formed in the blow nozzle, with the smaller face of the truncated cone being disposed directly at the nozzle opening, the sound-absorbing insert being a rigid structure formed of sintered bronze spheres having a power grain-size.

3 Claims, 1 Drawing Sheet

SOUND ABSORPTION DEVICE OR MUFFLER FOR BLOW NOZZLES

The invention relates to a sound absorption device or muffler for blow nozzles, more particularly, for use in feeder, alignment and delivery regions of offset printing machines, the sound absorption device having a sound absorbing insert which muffles noise having frequencies ranging over the entire audible frequency range which results from a change in density of a gas flow, such as an air flow, in particular, as it streams through a nozzle opening.

Blow nozzles play an important role in the transport of paper in offset printing machines, for example, because paper movement controlled by blown air offers the advantage that the paper transport or transfer takes place very gently by this method instead of by a mechanical action. The installation of nozzles to direct or guide blown air is especially significant if paper which has already been printed would otherwise come into contact with mechanical parts.

A disadvantage of the use of blow nozzles, however, is the noise which arises as the gas exits from the nozzle. Due to the constriction of the flow cross section in the nozzle, the flow of gas is impeded, leading to the production of fluctuations in the gas density in the bore of the blow nozzle. The cylindrical bore of the blow nozzle acts as a resonator and, as the gas flows out of the nozzle opening, the density fluctuations are dispersed into the surrounding area as sound waves; the faster the speed with which the gas flows out, the greater the intensity of the sound. Depending upon the number of blow nozzles, the noise developed thereby constitutes a considerable part of the noise level of the printing machine during operation thereof.

Because noise pollution, on a long-term basis, leads to stress situations and consequently to reduced performance, and even to health damage, care must be taken to ensure that the noise level of a printing machine remains limited to a minimum, for the protection of the operating personnel.

The conventional method for sound absorption of pneumatic devices is to divide up or distribute the gas flow by means of a labyrinthine branching system (flow restrictor or throttle member) before it exits from the nozzle. Due to the intermolecular friction facilitated by the formation of vortices, and also because of the interaction of the molecules with the interior walls of the flow restrictor or throttle member, kinetic energy and, accordingly, sound energy are irreversibly transformed into heat.

In German Patent 12 50 220, a blocking and throttle valve has been disclosed, which can be used for low-noise and low vibration throttling of flowing gaseous media, and especially for reducing the pressure of steam. The sound absorber is mounted on the high pressure side of the valve, in the immediate vicinity of the valve cone of the locking member, so that there is no resonance space suitable for the formation of disruptive sound waves behind the valve seat. The sound absorber per se is a cylindrical jacket with a conical cap mounted on one end face thereof formed with holes or openings extending perpendicularly to the outer surface thereof. Because the sound absorption is more intensive, the more limited the formation of free flows, it is further proposed in this German patent that a very large number of these conical cylinder caps be arranged serially, i.e. one behind the other, in such a manner that the holes are offset from one another. Another proposal for solving the foregoing problem provides for filling the cylinder with a loose charge or load of spheres or balls.

The first-mentioned proposal in the German patent would scarcely be able to provide effective noise absorption according to the aforedescribed. The second proposed solution requires a far too complicated technical construction for it to be manufactured as a mass-production item at economical prices. Sound absorption by means of a loose charge or load of spheres or balls would appear at first sight to be a suitable solution. However, it must be taken into consideration that space is left for the loose balls to have a given amount of play therein, so that they are set into vibration in the gas flow, thereby themselves representing a source of noise. Furthermore, care must be taken that if smaller-sized grains are chosen, the flow resistance increases. Within the range of high pressures, wherein blow-off or pressure-relief valves usually operate, this might only have a secondary effect on the gas flow rate. In contrast therewith, however, within the range of lower pressures, as are used for blow nozzles in printing machines, care must be taken to ensure that the flow rate of the nozzle, and thus its functioning ability, is only negligibly changed by the selection of the sound-absorbing insert.

It is accordingly an object of the invention to provide a blow nozzle with a sound-absorbing insert which can be relatively simply produced by mechanical means, and which limits to a minimum the noise created by the released outflow of gas from the nozzle, without too much of a reduction in the manner in which the blow nozzle functions, in particular, in the gas flow rate within the range of low pressures.

With the foregoing and other objects in view, there is provided, in accordance with the invention, a sound absorption device for a blow nozzle formed with a bore extending from a low-pressure side of the nozzle, at which a gas flow enters the nozzle, to a high-pressure side of the nozzle, at which the gas flow streams from the nozzle through a nozzle opening formed at an end of the bore, the sound absorption device comprising a sound-absorbing insert for muffling noise which results from a variation in density of the gas flow as it streams through the nozzle opening and has frequencies ranging over substantially the entire audible frequency range, the sound-absorbing insert being shaped as a truncated cone and being rigidly set into the bore formed in the blow nozzle, with the smaller face of the truncated cone being disposed directly at the nozzle opening, the sound-absorbing insert being a rigid structure formed of sintered bronzed spheres having a powder grain-size.

In accordance with another feature of the invention, the sintered bronze spheres have a substantially uniform structure, and substantially all of the spheres, respectively, engage one another at a single point. Due to tight packing of the sintered bronze spheres, on the one hand, effective sound absorption is achieved by the constant deflection of the gas flow. On the other hand, adequate air space remains between the spheres as a result of the point contact locations, so that there is a minimal adverse effect upon the gas flow rate.

In accordance with a concomitant feature of the invention, there is provided, in blow nozzles disposed in at least one region of feeder, aligning and delivery regions of an offset printing machine and formed with respective bores extending from an air-inlet side of the nozzles to an air-outlet side of the nozzles, a sound absorption device comprising a sound-absorbing insert for muffling noise resulting from a change in density of an air flow as it streams through a nozzle opening formed at the air-outlet side of the nozzles, the sound-absorbing insert having a frustoconical shape and being firmly secured in the bore formed in the respective nozzle, the smaller face of the frustoconical insert being located at the nozzle opening, the sound-absorbing insert being a rigid structure formed of sintered bronze spheres having a grain size of powder.

Other features which are considered as characteristic for the invention are set forth in the appended claims.

Although the invention is illustrated and described herein as embodied in a sound absorption device or muffler for blow nozzles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Like parts in all of the figures are identified by the same reference numerals.

Figure 1:
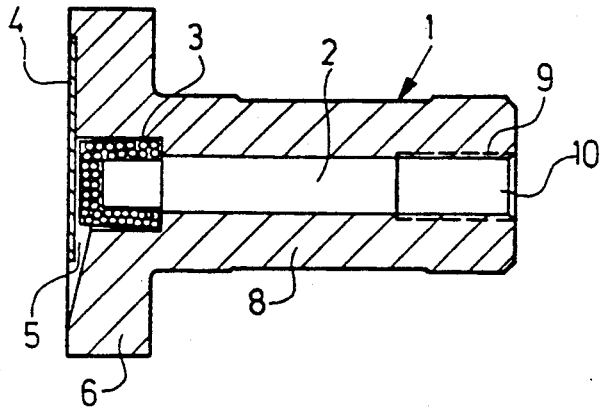
FIG. 1 is a longitudinal sectional view of a sound-absorbed or muffled blow nozzle.

Referring now to the drawing and, first, particularly to FIG. 1 thereof, there is shown therein a blow nozzle 1, which permits a right-angled deflection of a gas flow. The blow nozzle is mechanically produced. It is formed of a cylinder 8 and a nozzle plate 6, connected thereto and having, recessed in an underside thereof, a wedge-shaped depression or cavity extending over the area of a circular segment directed towards the central axis of the blow nozzle. The blow nozzle 1 is formed with a radially symmetrical bore 2 which is covered by a cover plate 4 fixed to the underside of the nozzle plate 6 at the left-hand side of FIG. 1. The cover plate 4, together with the wedge-shaped depression or cavity, forms a nozzle opening 5. The bore 2 is closed in gas outlet direction by a sound-absorbing or muffling sintered bronze insert 3 having a smaller end face extending directly to the cover plate 4. A thread 9 is milled into the opposite end of the bore 2. The blow nozzle 1 can be connected via a feed pipe 10 to a blowing air source not shown in the drawing.

Figure 2:
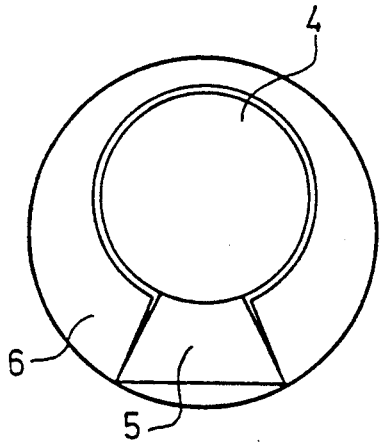
FIG. 2 is a plan view of FIG. 1 at the left-hand end of the blow nozzle showing the underside of the nozzle plate of the sound-absorbed or muffled blow nozzle.

FIG. 2 is a plan view of the lower side of the nozzle plate 6 of the sound-absorbing or muffling blow nozzle 1 shown in FIG. 1.

Figure 3:
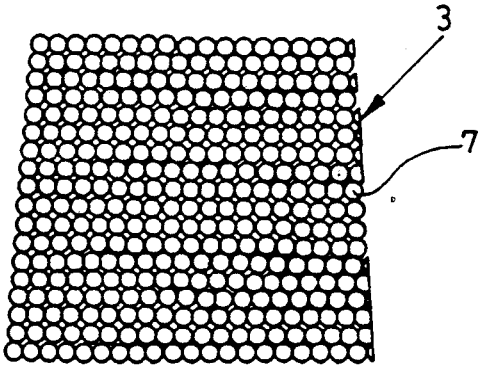
FIG. 3 is an enlarged fragmentary side elevational view of FIG. 2 showing a sound-absorbing insert formed of sintered bronze.

Indeed, with this construction of the blow nozzle 1, which is intended to provide a right-angled deflection of the gas flow, the noise created without the sound-absorbing insert is particularly loud and disturbing. The construction essentially corresponds to that of a pipe, so that the generation of a corresponding noise also is noticeable. The noise level of a multiplicity of this special type of blow nozzles 1, which are used for prealigning a sheet at a feeder board of printing machines, can be reduced to a tolerable level with the aid of the sound-absorbing insert. In FIG. 3, a cross-sectional view of the sound-absorbing insert 3 formed of sintered spheres or balls 7 is shown. The individual balls 7 are rigidly linked to one another and have only point contacts with neighboring sintered bronze balls 7.

Even when the grain size is relatively small, enough air space remains between the sintered bronze balls or spheres 7 so that the flow rate is only slightly reduced when gas flows through the sound-absorbing insert 3 at low pressure.

The foregoing is a description corresponding in substance to German Application P 39 00 723.5, dated Jan. 12, 1989, the international priority of which is being claimed for the instant application, and which is hereby made part of this application. Any material discrepancies between the foregoing specification and the aforementioned corresponding German application are to be resolved in favor of the latter.

I claim:

1. Sound absorption device for a blow nozzle formed with a bore extending from a low-pressure side of the nozzle, at which a gas flow enters the nozzle, to a high-pressure side of the nozzle, at which the gas flow streams from the nozzle through a nozzle opening formed at an end of the bore, the sound absorption device comprising a sound-absorbing insert for muffling noise which results from a variation in density of the gas flow as said gas flow streams through the nozzle opening and has frequencies ranging over a frequency range substantially between limits of human audible perception, said sound-absorbing insert being shaped as a truncated cone and being rigidly set into the bore formed in the blow nozzle, said insert having a relatively smaller and a relatively larger face, with the smaller face of the truncated cone being disposed directly at the nozzle opening, said sound-absorbing insert being a rigid structure formed of sintered bronze spheres having a powder grain-size.

2. Sound absorption device according to claim 1, wherein said sintered bronze spheres have a substantially uniform structure, and substantially all of said spheres, respectively, engage one another at a single point.

3. In blow nozzles disposed in at least one region of a feeder region, an aligning region and a delivery region of an offset printing machine and formed with respective bores extending from an air-inlet side of the nozzles to an air-outlet side of the nozzles, a sound absorption device comprising a sound-absorbing insert for muffling noise resulting from a change in density of an air flow as said gas flow streams through a nozzle opening formed at the air-outlet side of the nozzles, said sound-absorbing insert having a frustoconical shape and being firmly secured in the bore formed in the nozzles, said insert having a relatively smaller and a relatively larger face, the smaller face of the frustoconical insert being located at said nozzle opening, said sound-absorbing insert being a rigid structure formed of sintered bronze spheres having a grain size of powder.

* * * * *